US012116760B2

(12) United States Patent
Eilmus et al.

(10) Patent No.: US 12,116,760 B2
(45) **Date of Patent: *Oct. 15, 2024**

(54) SINK WITH INTEGRATED RINSE FEATURE

(71) Applicant: Kohler Co., Kohler, WI (US)

(72) Inventors: Niels Eilmus, Sheboygan, WI (US); Chanseol Chung, Milwaukee, WI (US); Steven F. Ellingson, Plymouth, WI (US); Christopher Santos, Sheboygan Falls, WI (US)

(73) Assignee: Kohler Co., Kohler, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/347,455

(22) Filed: Jul. 5, 2023

(65) Prior Publication Data

US 2023/0340766 A1 Oct. 26, 2023

Related U.S. Application Data

(63) Continuation of application No. 17/345,896, filed on Jun. 11, 2021, now Pat. No. 11,732,450.
(Continued)

(51) Int. Cl.

| | |
|---|---|
| ***E03C 1/048*** | (2006.01) |
| ***E03C 1/046*** | (2006.01) |
| ***E03C 1/182*** | (2006.01) |

(52) U.S. Cl.
CPC ..... *E03C 1/048* (2013.01); *E03C 1/046* (2013.01); *E03C 1/182* (2013.01)

(58) Field of Classification Search
CPC ..... E03C 1/048; E03C 1/046; E03C 1/182; E03C 1/057; E03C 1/0404; E03C 1/04;
(Continued)

(56) References Cited

U.S. PATENT DOCUMENTS

| | | | |
|---|---|---|---|
| 4,809,369 | A | 3/1989 | Bowden |
| 5,868,311 | A | 2/1999 | Cretu-Petra |

(Continued)

FOREIGN PATENT DOCUMENTS

| | | |
|---|---|---|
| CA | 3083422 | 6/2019 |
| CN | 2518919 Y | 10/2002 |

(Continued)

OTHER PUBLICATIONS

Chinese Second Office Action CN Application No. 201911335966.X dated Jan. 26, 2021 9 pages.

(Continued)

*Primary Examiner* — Lori L Baker
(74) *Attorney, Agent, or Firm* — Husch Blackwell LLP

(57) ABSTRACT

A sink system includes a basin and a rinsing system. The basin includes a first wall configured to contain water within the basin. The rinsing system is integrated with the basin. The rinsing system includes one or more water outlets and a fluid conduit. The one or more water outlets are located along the first wall of the basin and are configured to dispense water into the basin. The fluid conduit extends at least partially along the first wall of the basin. The fluid conduit is fluidly coupled to the one or more water outlets and is configured to deliver water to the one or more water outlets.

20 Claims, 11 Drawing Sheets

Related U.S. Application Data

(60) Provisional application No. 63/056,997, filed on Jul. 27, 2020.

(58) Field of Classification Search
CPC ..... E03C 1/0401; E03C 1/0405; E03C 1/10; E03C 2001/0414; A47L 15/0086; A47L 15/4217; A47L 15/46
USPC ... 4/638, 619, 517, 546, 597, 628, 629, 630, 4/631, 653
See application file for complete search history.

(56) References Cited

U.S. PATENT DOCUMENTS

| | | | |
|---|---|---|---|
| 8,683,624 | B1 | 4/2014 | Zhadanov et al. |
| 9,157,219 | B2 | 10/2015 | Gibson |
| 9,578,994 | B2 | 2/2017 | Capp et al. |
| 9,708,802 | B2 | 7/2017 | Gibson |
| 10,221,547 | B2 | 3/2019 | Gibson |
| 10,369,578 | B2 | 8/2019 | Allard |
| 10,501,919 | B2 | 12/2019 | Chong et al. |
| 10,870,973 | B2 | 12/2020 | Gibson |
| 11,384,518 | B2 | 7/2022 | Gibson |
| 11,739,510 | B2 | 8/2023 | Gibson |
| 2007/0174958 | A1 | 8/2007 | McKay, Jr. |
| 2008/0271238 | A1 | 11/2008 | Reeder et al. |
| 2010/0254125 | A1 | 10/2010 | Jones et al. |
| 2012/0124737 | A1 | 5/2012 | Gibson |
| 2018/0187403 | A1 | 7/2018 | Chong et al. |

FOREIGN PATENT DOCUMENTS

| | | | | |
|---|---|---|---|---|
| CN | 201683348 | | 12/2010 | |
| CN | 201891204 | | 7/2011 | |
| CN | 202190986 | | 4/2012 | |
| CN | 202298800 | | 7/2012 | |
| CN | 103502542 | | 1/2014 | |
| CN | 203627979 | | 6/2014 | |
| CN | 105839719 | A | 8/2016 | |
| CN | 106617873 | A | 5/2017 | |
| CN | 107313482 | | 11/2017 | |
| CN | 206616755 | | 11/2017 | |
| CN | 207640863 | | 7/2018 | |
| CN | 208650177 | | 3/2019 | |
| CN | 219343400 | U | 7/2023 | |
| JP | 2003-079528 | | 3/2003 | |
| JP | 2016179173 | | 10/2016 | |
| KR | 102619936 | B | 1/2024 | |
| KR | 20240006478 | A | 1/2024 | |
| KR | 20240006479 | A | 1/2024 | |
| WO | WO 2010132898 | | 11/2010 | |
| WO | WO-2010132898 | A1 * | 11/2010 | ..... A47L 15/00 |
| WO | WO 2012033350 | | 3/2012 | |

OTHER PUBLICATIONS

Extended European Search Report on EP Appl. Ser. No. 21186904.5 dated Mar. 3, 2022 (10 pages).
Extended European Search Report for EP Appl. Ser. No. 19217790.5 dated Apr. 22, 2020 (8 pages).
First Chinese Office Action for CN Appl. Ser. No. 201911335966.X dated Sep. 23, 2020 (11 pages) (English Translation).
Gizmodo, Ceiling-Mounted Bathroom Faucet Would be Great for Quick Showers. 2009. https://gizmodo.com/ceiling-mounted-bathroom-faucet-would-be-great-for-quic-5390931.
Hansgrohe, "Aquno Select High Arc Kitchen Faucet, 3-Spray Pull-Down, 1.75 GPM," retrieved from https://www.hansgrohe-USA.com/ articledetail-aquno -select-higharc -kitchen-faucet-3 -spray-pull-down- 1-75-gpm-73837801, 3 pages (2021).
Kohler, "Crevasse Preparation Sink K-6448," retrieved from https://www.us.kohler.com/us/Crevasse-35-5-8-x-8-1-8-x-7-3-8-under- mount-single-bowl-bar-sink-with-Cynchronus-rinsing-technology/productDetail/product:426585/426585.htm, 2 pages (2021).

* cited by examiner

SINK WITH INTEGRATED RINSE FEATURE

CROSS-REFERENCE TO RELATED PATENT APPLICATION

This application is a continuation of application Ser. No. 17/345,896, filed Jun. 11, 2021, which claims the benefit of Provisional Application No. 63/056,997 filed Jul. 27, 2020, the entire disclosures of which are incorporated by reference herein.

BACKGROUND

The present disclosure relates generally to sink systems. Conventional sink systems typically include a basin having one or more drains and a faucet. The faucet may include a repositionable faucet head having a spray functionality. The repositionable faucet head allows a user to manually reposition the faucet head as necessary to wash the desired object (e.g., dishes, cutlery, fruits and vegetables, etc.).

SUMMARY

One implementation of the present disclosure is a sink system includes a basin and a rinsing system. The basin includes a first wall configured to contain water within the basin. The rinsing system is integrated with the basin. The rinsing system includes one or more water outlets and a fluid conduit. The one or more water outlets are located along the first wall of the basin and are configured to dispense water into the basin. The fluid conduit extends at least partially along the first wall of the basin. The fluid conduit is fluidly coupled to the one or more water outlets and is configured to deliver water to the one or more water outlets.

In some embodiments, the basin further may include a second wall opposite the first wall. The one or more water outlets are configured to dispense the water into the basin in a direction substantially from the first wall toward the second wall.

In some embodiments, the basin may include one or more additional walls coupled to the first wall. The first wall and the one or more additional walls forming a perimeter of the basin with the first wall. The one or more water outlets may include a plurality of water outlets distributed across the first wall and the one or more additional walls along the perimeter of the basin.

In some embodiments, the sink system may further include a faucet including a first faucet outlet located along a first surface of the faucet and configured to dispense water from the faucet. In some embodiments, the fluid conduit includes a faucet connector configured to connect to the first faucet outlet. In some embodiments, the fluid conduit is configured to receive the water dispensed from the first faucet outlet via the faucet connector and deliver the water from the faucet to the one or more water outlets.

In some embodiments, the faucet further includes a second faucet outlet located along a second surface of the faucet opposite the first surface and configured to dispense water from the faucet into the basin concurrently with the faucet providing water to the fluid conduit via the first faucet outlet.

In some embodiments, the fluid conduit is fluidly coupled to a water source via a water line that extends through a wall of the basin and configured to receive the water from the water source via the water line and deliver the water from the water source to the one or more water outlets.

In some embodiments, the basin includes an overflow hole located along a wall of the basin and configured to direct at least some of the water within the basin to a drain when a water level of the water within the basin reaches the overflow hole. A first distance between the one or more water outlets and a bottom surface of the basin may be less than a second distance between the overflow hole and the bottom surface of the basin such that the water level is above the one or more water outlets when the water level reaches the overflow hole.

In some embodiments, the sink system further includes a vacuum breaker configured to prevent the water within the basin from flowing into the one or more water outlets.

Another implementation of the present disclosure is a sink system including a faucet and a basin. The faucet includes a first faucet outlet located along a first surface of the faucet and configured to dispense water from the faucet in a first direction and a second faucet outlet located along a second surface of the faucet opposite the first surface and configured to dispense water from the faucet in a second direction opposite the first direction. The basin includes one or more water outlets located along a wall of the basin and a fluid conduit. The fluid conduit is configured to connect to the first faucet outlet, receive water dispensed from the faucet via the first faucet outlet, and deliver the water dispensed from the faucet to the one or more water outlets located along the wall of the basin.

In some embodiments, the sink system further includes one or more electronic valves operable to control a flow of water from the first faucet outlet and the second faucet outlet and a controller configured to operate the one or more electronic valves to control the flow of water from the first faucet outlet and the second faucet outlet.

In some embodiments, the sink system further includes a sensor configured to detect whether the first faucet outlet is connected to the fluid conduit. The controller may be configured to cause the faucet to dispense the water from both the first faucet outlet and the second faucet outlet concurrently responsive to detecting that the first faucet outlet is connected to the fluid conduit.

In some embodiments, the fluid conduit includes a faucet connector located along a first wall of the basin and configured to connect the first faucet outlet to the fluid conduit. The fluid conduit may extend around the basin from the first wall of the basin to a second wall of the basin opposite the first wall of the basin. The one or more water outlets may be located along the second wall of the basin.

In some embodiments, when the first faucet outlet is connected to the fluid conduit, the water dispensed from the first faucet outlet in the first direction flows into the fluid conduit via the faucet connector and then from the fluid conduit into the basin via the one or more water outlets located along the wall of the basin. When the first faucet outlet is connected to the fluid conduit, the water dispensed from the second faucet outlet in the second direction may flow directly into the basin from the second faucet outlet.

In some embodiments, the wall of the basin is a first wall. In some embodiments, the basin includes one or more additional walls coupled to the first wall. The first wall and the one ore more additional walls forming a perimeter of the basin with the first wall. In some embodiments, the one or more water outlets includes a plurality of water outlets distributed across the first wall and the one or more additional walls along the perimeter of the basin.

Another implementation of the present disclosure is a sink system including a basin including a plurality of water outlets located along one or more walls of the basin and configured to spray water into the basin, a removable cover configured to attach to the basin and enclose at least a portion of the basin comprising the plurality of water outlets, and a controller configured to operate in a dishwashing mode in which the controller causes the plurality of water outlets to spray the water into the basin according to a predetermined dishwashing cycle.

In some embodiments, the sink system further includes a cleaning agent reservoir configured to store a supply of cleaning agent. The dishwashing cycle may include a washing sub-cycle during which the cleaning agent mixes with the water upstream of the plurality of water outlets and a mixture of the cleaning agent and the water sprays into the basin via the plurality of water outlets. In some embodiments, a pressure difference between the water upstream of the plurality of water outlets and the cleaning agent reservoir (e.g., hydraulic or hydropneumatic pressure differentiation) causes the cleaning agent to be drawn into the water upstream of the plurality of water outlets. The dishwashing cycle may include a rinsing sub-cycle during which the cleaning agent is prevented from mixing with the water upstream of the plurality of water outlets and rinse water sprays into the basin via the plurality of water outlets.

In some embodiments, the sink system of further includes a faucet. The faucet may include a first faucet outlet located along a first surface of the faucet and configured to dispense water from the faucet in a first direction and a second faucet outlet located along a second surface of the faucet opposite the first surface and configured to dispense water from the faucet in a second direction opposite the first direction.

In some embodiments, the sink system further includes one or more electronic valves operable to control a flow of water from the first faucet outlet and the second faucet outlet and a controller configured to operate the one or more electronic valves to control the flow of water from the first faucet outlet and the second faucet outlet.

In some embodiments, the sink system further includes a sensor configured to detect whether the first faucet outlet is connected to a faucet enclosure disposed in the basin. The controller may be configured to cause the faucet to dispense the water from the second faucet outlet responsive to detecting that the first faucet outlet is connected to the faucet enclosure.

In some embodiments, the sink system further includes a sensor configured to detect whether the first faucet outlet is connected to a fluid conduit fluidly coupled to the plurality of water outlets. The controller may be configured to cause the faucet to dispense the water from both the first faucet outlet and the second faucet outlet responsive to detecting that the first faucet outlet is connected to the fluid conduit.

This summary is illustrative only and is not intended to be in any way limiting.

BRIEF DESCRIPTION OF THE FIGURE

The details of one or more implementations are set forth in the accompanying drawings and the descriptions below. Other features, aspects, and advantages of the disclosure will become apparent from the description, the drawings, and the claims.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Sinks are used frequently in daily life in various environments, such as kitchens, bathrooms, laundry rooms, and the like. Depending on the intended use of the sink, it may be advantageous for the sink itself to include an integrated rinse system that is separate and distinct from a faucet or an auxiliary hand sprayer associated with the sink. For example, it may be desirable for the sink to have multiple rinsing stations to rinse dishes. Additionally, it may be desirable to have an integrated rinse system along the perimeter of the sink.

The various exemplary embodiments described herein are directed to a washing assembly, such as a sink system, that includes an integrated rinse system within a basin of the sink that is capable of providing additional rinsing capabilities in a variety of ways to provide enhanced functional benefits as compared to other conventional sinks.

Some exemplary embodiments described herein are directed to sink systems that include an integrated rinse system that is manually initiated by a user via a button or automatically activated by a user through, for example, one or more touchless sensors (e.g., proximity sensors, etc.). This integrated rinse system may also include a direct soap injection and may be configured to have an increased pressure to improve rinsing capabilities.

Some exemplary embodiments described herein are directed to sink systems that include a plurality of integrated rinse features used in conjunction with a removable cover. These integrated rinse features may be configured to provide a dedicated dishwashing mode within a section of the sink.

Some exemplary embodiments described herein are directed to sink systems that include multiple integrated rinse features along the perimeter of the sink. These multiple integrated rinse features can provide uniform rinsing of the sink from the perimeter to the center of the sink to provide better rinsing of, for example, tableware and cutlery.

Figure 1:
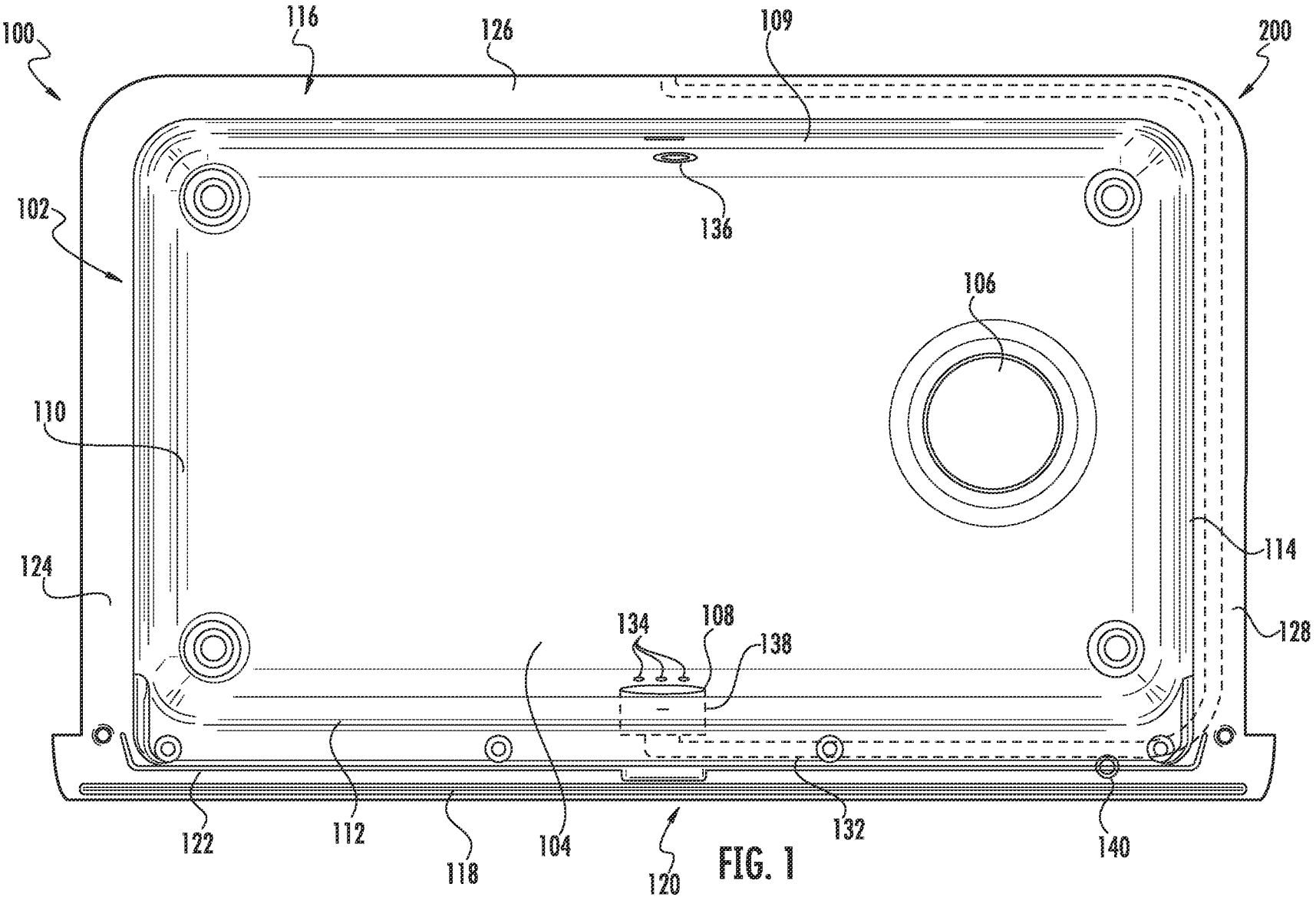
FIG. 1 is a top view of a sink system, according to some embodiments.

FIG. 1 depicts a sink system 100 (e.g., kitchen sink system, counter sink system), according to an exemplary embodiment. As explained in more detail herein, the sink system 100 may include an integrated rinse system that is configured to augment capabilities and functionalities of a traditional sink such that the sink system 100 is more desirable than a traditional sink. In some embodiments, the integrated rinse system includes rinsing elements (e.g., sprayers, spray nozzles, fluid output device, etc.) that are selectively used to provide rinsing/cleaning capabilities within the sink. The rinsing elements may be integrated (e.g., coupled to or integrally formed with) directly within various portions of the sink system 100, such as within the basin of the sink. In this way, the sink system 100 can provide a hands-free rinsing/cleaning capability inside the sink basin without requiring a user to hold a separate sprayer, faucet, or other auxiliary spraying device within the sink. In addition, the disclosed sink system may eliminate the need for separate installation of auxiliary sprayers and associated components, as typically required with a traditional sink to provide similar capabilities.

The sink system 100 is shown to include a basin 102. As explained in more detail herein, the basin 102 may be configured to receive water, facilitate use of the water within the basin 102, and provide water from the basin 102 to a drain (e.g., to a sink drain conduit).

As shown in FIG. 1, the basin 102 includes a bottom wall 104 that includes a drain 106 formed therein. As is explained in more detail herein, the basin 102 is configured to provide water from a faucet 202 (shown in FIG. 2) such as a kitchen faucet, to the drain 106, and the drain 106 is configured to pass water from the basin 102. The drain 106 is configured to be coupled to (e.g., attached to, joined with, integrally formed with, fastened to, threaded onto, threaded into) a sink drain conduit (e.g., pipe, fitting, disposal, drain pipe) and to provide water from the basin 102 to the sink drain conduit.

As shown, the basin 102 includes a front wall 112. The front wall 112 is contiguous with (e.g., connected to, shares a border with, extending from) the bottom wall 104. The basin 102 may also include a first side wall 110. The first side wall 110 is contiguous with the bottom wall 104 and the front wall 112. In some embodiments, the front wall 112 and the first side wall 110 are approximately (e.g., within 5% of) orthogonal.

In some embodiments, the basin 102 also includes a second wall such as a rear wall 109. The rear wall 109 is contiguous with the bottom wall 104 and the first side wall 110. In some embodiments, the front wall 112 and the rear wall 109 are approximately parallel (e.g., horizontal within 5 degrees of horizontal, within 10 degrees of horizontal, within 25 degrees of horizontal, etc.). The basin 102 may also include a second side wall 114. The second side wall 114 is contiguous with the bottom wall 104, the front wall 112, and the rear wall 109. In some embodiments, the front wall 112 and the second side wall 114 are approximately orthogonal. In some embodiments, the rear wall 109 and the second side wall 114 are approximately orthogonal. In various embodiments, the front wall 112, the first side wall 110, the rear wall 109, and the second side wall 114 generally define (e.g., are disposed along edges of) a rectangle or a square having sides that intersect at linear or rounded edges (e.g., filets or chamfers).

The basin 102 is also shown to include a basin rim 116. As is explained in more detail herein, the basin rim 116 facilitates attachment of the basin 102 to an apron 118 (e.g., skirt, panel). The apron 118 is in confronting relation (e.g., disposed adjacent to) the front wall 112.

The basin rim 116 is also shown to include a rim front side 122. The rim front side 122 is contiguous with the front wall 112 and extends (e.g., projects, protrudes) from the front wall 112 away from the rear wall 109. In various embodiments, the rim front side 122 is coupled to the apron 118.

As shown, the basin rim 116 also includes a rim first side 124. The rim first side 124 is contiguous with the first side wall 110 and the rim front side 122. The rim first side 124 extends from the first side wall 110 away from the second side wall 114.

The basin rim 116 is also shown to include a rim rear side 126. The rim rear side 126 is contiguous with the rear wall 109 and the rim first side 124 and extends from the rear wall 109 away from the front wall 112. In various embodiments, the rim rear side 126 is not coupled to the apron 118. In some embodiments, the rim rear side 126 interfaces with a counter structure 120 (e.g., on a beam of the counter structure 120).

The basin rim 116 is also shown to include a rim second side 128. The rim second side 128 is contiguous with the second side wall 114, the rim rear side 126, and the rim front side 122. The rim second side 128 extends from the second side wall 114 away from the first side wall 110. In some embodiments, the rim second side 128 interfaces with the counter structure 120 (e.g., on a beam of the counter structure 120).

In some embodiments, at least a portion of the rim front side 122, at least a portion of the rim first side 124, at least a portion of the rim rear side 126, and at least a portion of the rim second side 128 are disposed along the same plane. In this way, the basin rim 116 may be positioned at a uniform distance from a counter 130 of the counter structure 120.

In some embodiments, the sink system 100 also includes an integrated rinse system 200 (e.g., cleaning system, washing system, rinsing system, spraying system, etc.). As explained in more detail herein, the integrated rinse system 200 is configured to selectively provide rinsing from within the basin 102 of the sink system 100 through various mechanisms while being at least partially integrated within (e.g., integrally formed with, embedded in, coupled within, etc.) the basin 102, the basin rim 116, and/or the apron 118. In this way, the sink system 100 provides the integrated rinse system 200 without requiring a user to separately hold an auxiliary sprayer or requiring extensive installation and assembly of auxiliary components to provide similar rinsing capabilities.

The integrated rinse system 200 may include a sprayer 108 (e.g., nozzle, fluid output device, spray head, etc.) anywhere along the front wall 112. In some embodiments the sprayer 108 may be located anywhere along the first side wall 110, the second side wall 114, or the rear wall 109. According to other exemplary embodiments, the sprayer 108 may be located along a different portion of the basin 102. In an exemplary embodiment, the first side wall 110, the second side wall 114, or the rear wall 109 are formed to include an aperture to mount the sprayer 108. In various configurations, the first side wall 110, the second side wall 114, or the rear wall 109 include a passage or opening to allow for the sprayer 108 to be mounted therein.

Figure 2:
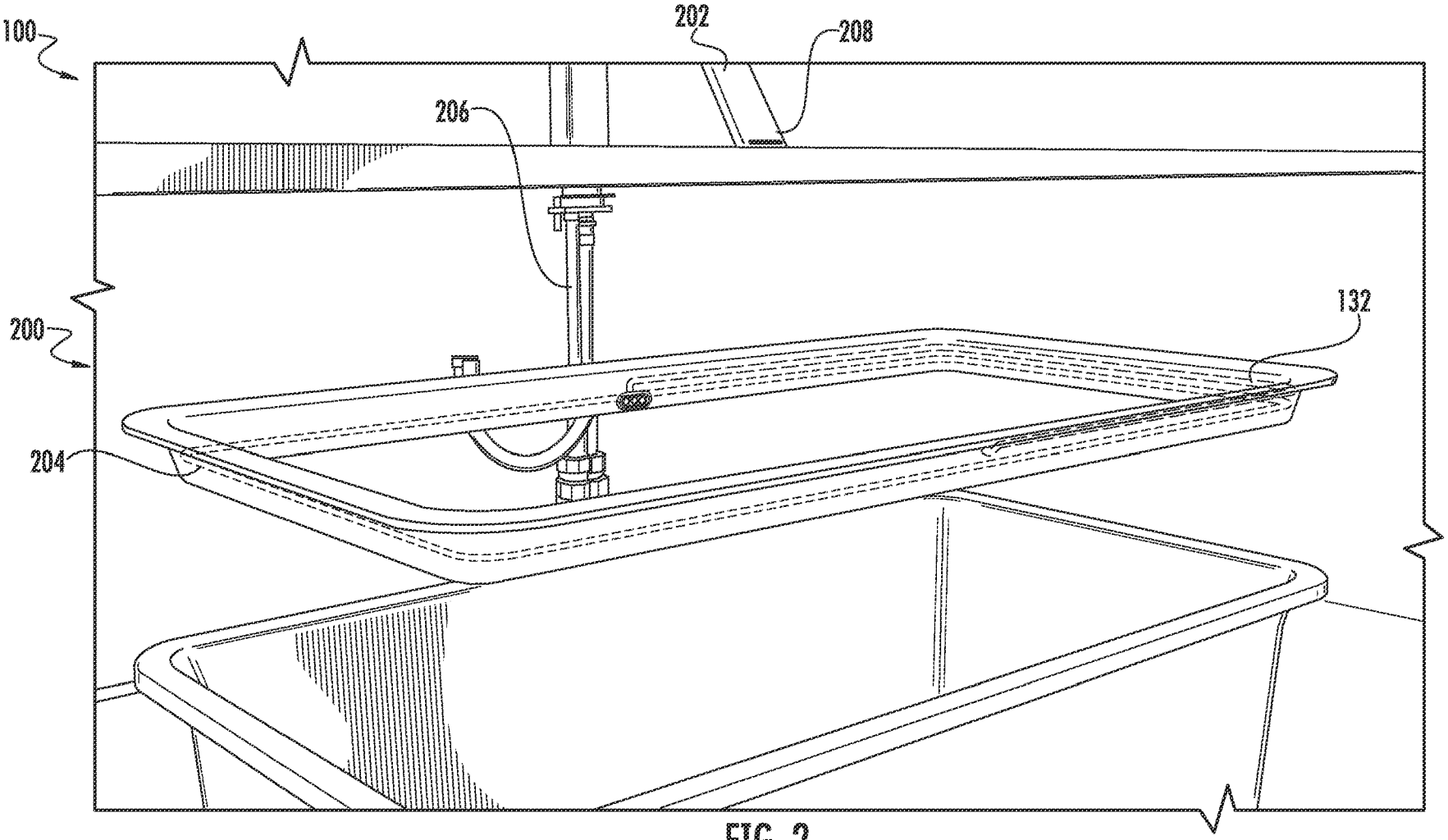
FIG. 2 is a side perspective and exploded view of the sink system of FIG. 1 illustrating water conduits located along a rim of the sink, according to some embodiments.

In an exemplary embodiment, the sprayer 108 may be fluidly communicable with a water supply 206, as shown in FIG. 2, for example. In the exemplary embodiment shown in FIG. 2, the sprayer 108 is fluidly communicable with a hot water supply. In various other embodiments, the sprayer 108 may be fluidly communicable with a cold water supply or a mixed water (hot and cold) supply. The sprayer 108 is fluidly communicable with the water supply 206 through a rinse conduit 132. The rinse conduit 132 may be integrated into the sink system 100, such as, for example, at least partially within the basin 102, basin rim 116, and/or the apron 118. In an example embodiment, the rinse conduit 132 is positioned along a perimeter of the sink system 100. In various embodiments, the rinse conduit 132 is positioned beneath the sink system 100. The rinse conduit 132 is coupled to the water supply 206 at a first end and is coupled to a rinse aperture 138 at a second end. In various embodiments, the rinse conduit 132 may be wrapped with a heated hose blanket to facilitate the sprayer 108 to spray a hot mist.

In some embodiments, the rinse conduit 132 may be fluidly coupled to a supply of a cleaning agent such as a soap or a detergent. For example, the sink system 100 may include a container or reservoir for holding a volume of soap that may be in fluid communication with the rinse conduit 132. In some embodiments, a hydraulic or a hypo-pneumatic pressure difference between the water and cleaning agent reservoir causes the cleaning agent to mix with the water. For example, pressure differences between the flowing water through the rinse conduit 132 and the static soap in the reservoir may cause the soap to be drawn into the rinse conduit 132 upstream of the water outlets. In some embodiments, a controller is configured to control the mixing of the water with the cleaning agent. The controller can control the mixing of the water with the cleaning agent in various ways. In some embodiments, the controller controls the mixing of the water with the cleaning agent by controlling the flow of water through the rinse conduit 132, which causes the soap to be drawn into the rinse conduit 132 as previously described. In some embodiments, the controller may operate a controllable valve to allow the soap to flow into the rinse conduit 132 (e.g., by opening the valve) or to block the soap from flowing into the rinse conduit 132 (e.g., by closing the valve). This can, advantageously, facilitate the rinse conduit 132 to directly and selectively inject soap within the rinse of the sprayer 108. In various embodiments, the soap supply may be coupled directly to the sprayer 108 to facilitate the dispensing of soap with the rinse.

As explained in more detail herein, the sprayer 108 may be activated manually by pressing a rinse button 140 (e.g., switch, knob, etc.). The rinse button 140 may be located along the basin rim 116 or anywhere along the apron 118. According to other exemplary embodiments, the rinse button 140 may activate the sprayer 108 for a predetermined amount of time. In various other embodiments, the rinse button 140 may activate the sprayer 108 for as long as the rinse button 140 is pressed. According to other exemplary embodiments, the rinse button 140 may be activated wirelessly via a software application on a mobile device (e.g., smartphone, tablet, etc.).

The sprayer 108 may also be activated automatically by a sensor 134 (e.g., motion detector, proximity sensor, heat detector, etc.). The sensor 134 may be a touchless sensor configured to detect the presence of an object within its vicinity. As explained in more detail herein, the sensor 134 sends a signal to a controller to activate the sprayer 108 to provide a spray of water. The sensor 134 may be positioned beneath the sprayer 108, according to an exemplary embodiment. According to other exemplary embodiments, the sensor 134 may be positioned anywhere within the vicinity of the sprayer 108. In some embodiments, there is more than one sensor 134 that may be located at various positions within the basin 102.

In an example embodiment, the integrated rinse system 200 includes both the sensor 134 and the rinse button 140 so as to allow both manual and automatic activation of the sprayer 108. According to other exemplary embodiments, the integrated rinse system 200 may include either the sensor 134 or the rinse button 140.

Figure 9:
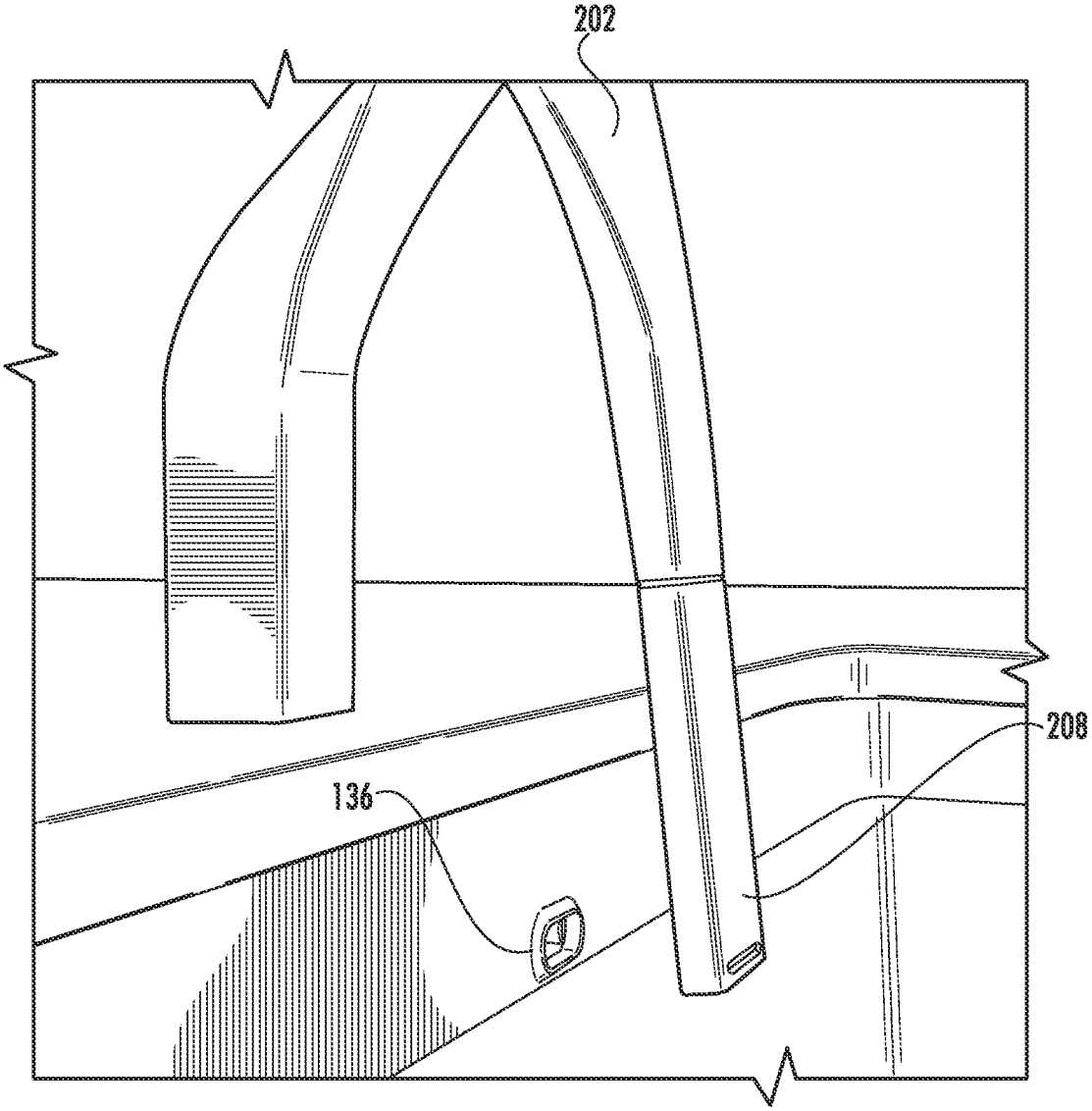
FIG. 9 is a side perspective view of the sink system of FIG. 1 illustrating the faucet positioned away from a faucet enclosure for the sink, according to some embodiments.

As shown in the exemplary embodiment of FIG. 2, the rinse conduit 132 is positioned along the basin rim 116. For example, the rinse conduit 132 may be located below a top surface of the basin rim 116 (e.g., embedded within the basin rim 116) and may extend along one or more sides 122-128 of the basin rim 116 to fluidly connect the sprayer 108 with a water source. The integrated rinse system 200 may include a ring conduit 204 in place of or in addition to the rinse conduit 132. As discussed in greater detail herein, the ring conduit 204 extends along the perimeter of the basin 102. In an example embodiment, the ring conduit 204 and/or the rinse conduit 132 are fluidly communicable with the faucet 202, where a faucet end 208 is positioned in a faucet enclosure 136 (as shown in FIG. 9 and described in greater detail with reference thereto). In an example embodiment, a water supply 206 is fluidly communicable with the faucet 202. In various embodiments, the ring conduit 204 and the rinse conduit 132 are independently fluidly communicable with the water supply 206, such that the water supply 206 provides water to both the faucet 202 independently to the ring conduit 204 and/or the rinse conduit 132.

In some embodiments, the integrated rinse system 200 includes a plurality of rinse buttons (e.g., such as the rinse button 140) to independently control the faucet 202, the ring conduit 204, and the rinse conduit 132. In some other embodiments, the integrated rinse system 200 includes a single rinse button configured to cycle (e.g., by repeatedly pressing the rinse button) between various spray options. The various spray options may include any combination of the faucet 202, the rinse conduit 132, and the ring conduit 204. For example, one spray option may include only activating the faucet 202, while another spray option activates the faucet 202, the rinse conduit 132, and the ring conduit 204. The integrated rinse system 200 may include one or more electronic flow control valves located with the sink system 100 configured to selectively divert water flow to any of the faucet 202, the rinse conduit 132, and the ring conduit 204. This configuration facilitates for the integrated rinse system 200 to dispense various spray options. The various spray options may be cycled through by pressing the single rinse button, the plurality of rinse buttons, detected motion by a proximity sensor (e.g., such as the sensor 134), or a smartphone application commutatively coupled to the integrated rinse system 200 or the sink system 100.

Figure 3:
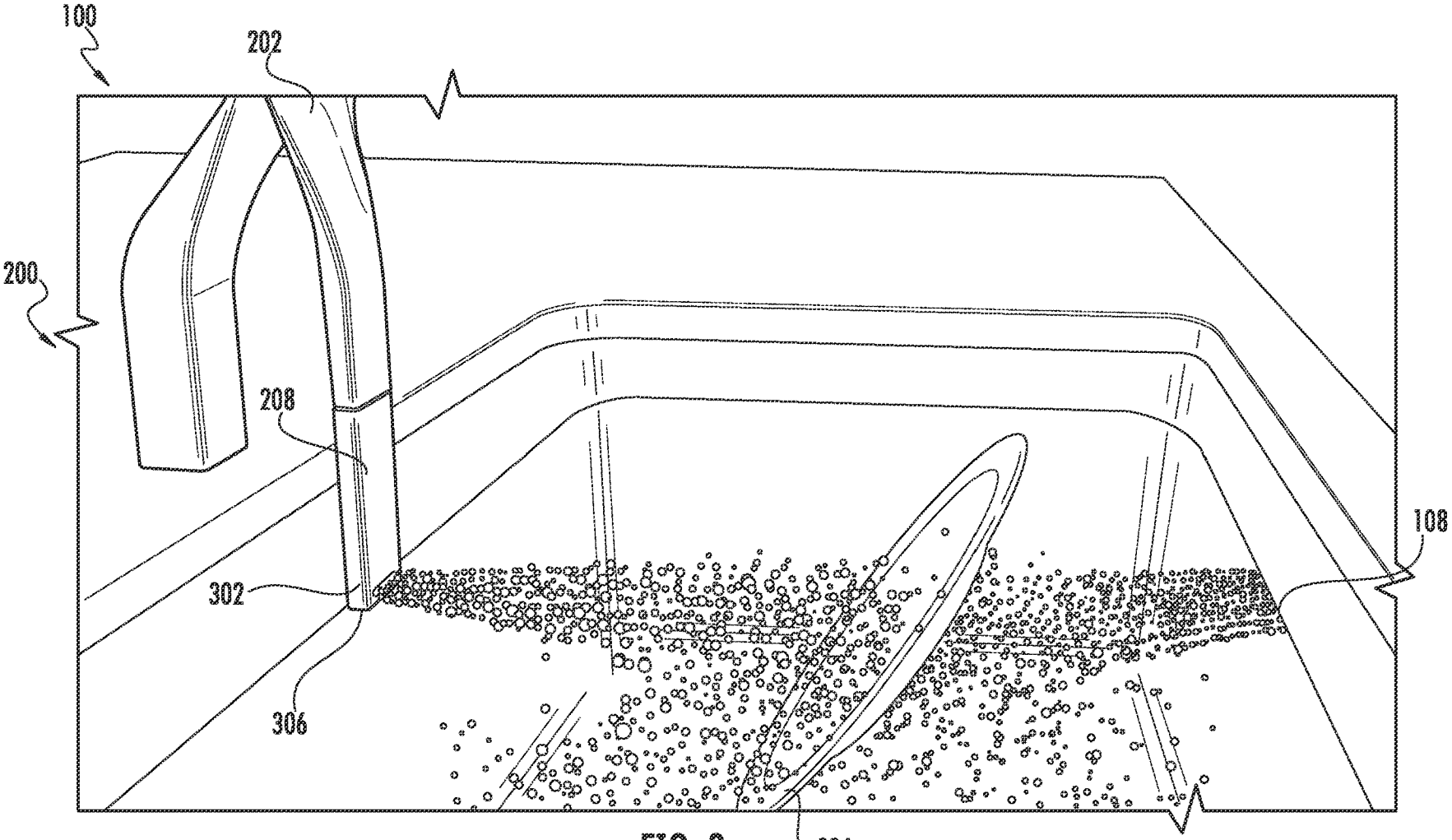
FIG. 3 is a side perspective view of the sink system of FIG. 1 illustrating an activated sprayer located along a basin of the sink and an activated faucet, according to some embodiments.

In the exemplary embodiment of FIG. 3, the integrated rinse system 200 is shown rinsing tableware 304. In an example embodiment, the sprayer 108 may produce multiple streams of water by using a plurality of rinse apertures 138 (e.g., spray nozzles, etc.). The plurality of rinse apertures 138 are disposed within a side wall 110, 114 of the basin 102. In an exemplary embodiment, the side wall 110, 114 is formed to include the plurality of rinse apertures 138. In various embodiments, the plurality of rinse apertures 138 may be created after the basin 102 is formed via a post-forming operation (e.g., drilling, milling, boring, etc.).

The plurality of rinse apertures 138 may be oriented to provide different spray patterns. For example, a plurality of rinse apertures 138 may be positioned along a horizontal plane. This particular spray pattern may be advantageous to provide a rinse along a line or plane of the basin 102. In various embodiments, a plurality of rinse apertures 138 may be positioned in a cluster pattern (e.g., compact pattern, compressed pattern, etc.), so as to provide a more targeted rinse. In another embodiment, a plurality of rinse apertures 138 may be positioned along an arc. This particular spray pattern may be advantageous to provide a rinse to various locations along, for example, tableware 304.

In an example embodiment, the sprayer 108 is oriented to direct a spray at a downward angle towards the drain 106 or angled downward by a different angle between 0 degrees and 90 degrees relative to horizontal, so as to avoid water splashing out of the basin 102. In various embodiments, the position of the sprayer 108 may be adjustable so that the rinsing angle may be adjusted to the user's preferences.

As shown in FIG. 3, the faucet end 208 includes a top side faucet outlet 302 and a bottom side faucet outlet 306. The top side faucet outlet 302 may be positioned on a top surface of the faucet end 208, whereas the bottom side faucet outlet 306 may be positioned on a bottom surface of the faucet end 208 opposite the top surface of the faucet end 208. In other words, the faucet end 208 incorporates a secondary outlet (e.g., the top side faucet outlet 302) positioned on a secondary surface of the faucet end 208. This allows for the faucet end 208 to dispense water in a direction than a conventional outlet (e.g., such as the bottom side faucet outlet 306). Accordingly the top side faucet outlet 302 and the bottom side faucet outlet 306 may be configured to output water in opposite directions and can be selectively activated depending on the desired mode of the faucet 202. When activated, the top side outlet 302 provides water to the basin 102. In some embodiments, the top side outlet 302 is configured to activate when the faucet end 208 is positioned in the faucet enclosure 136. In various embodiments, the top side outlet 302 is activated when the faucet end 208 is positioned within the faucet enclosure 136 and the sprayer 108 is activated. In these embodiments, the faucet enclosure 136 includes a sensor configured to detect the presence of the faucet end 208 in the faucet enclosure 136. The sensor provides a control signal to a controller as discussed in greater detail herein. The controller may automatically activate for water to be dispensed from the top side faucet outlet 302 or may to activate for water to be dispensed upon activation of the faucet 302 by the user (e.g., by turning on the faucet 302, by pressing a button, etc.).

In another embodiment, the top side outlet 302 is activated by a button to activate the top side outlet 302. In an example embodiment, the top side outlet 302, at the rear of the basin 102, and the sprayer 108 at the front of the basin 102, may both be activated to rinse the front and back of tableware 304 simultaneously. In this manner, the sink system 100 can provide enhanced rinsing capabilities within the sink basin 102.

Figure 4:
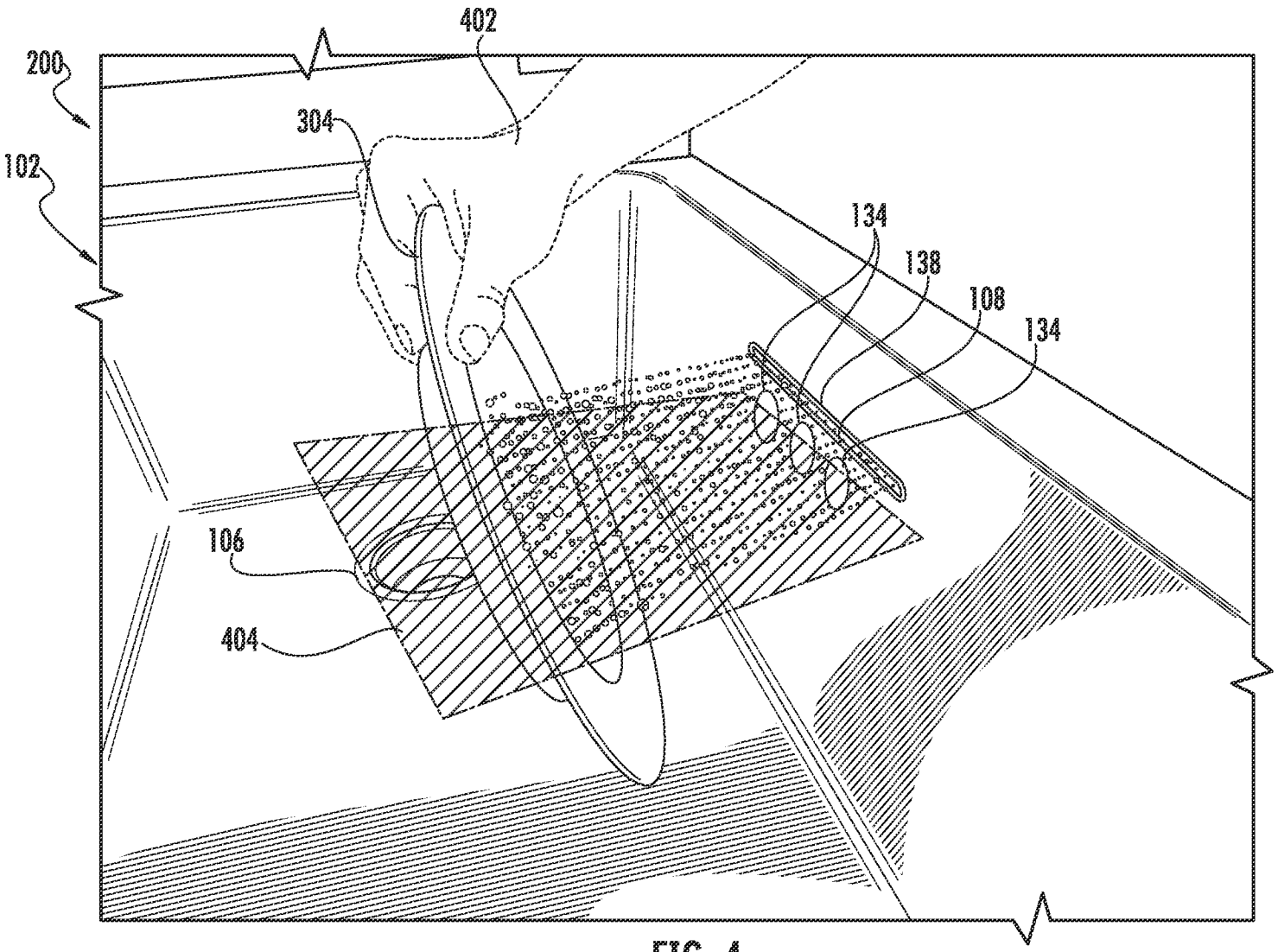
FIG. 4 is another side perspective view of the sink system of FIG. 1 illustrating sprayers and sensors located along a basin of the sink, according to some embodiments.

As shown in FIG. 4, the sprayer 108 is activated by the sensor 134. When a user 402 places tableware 304 within a detection zone 404, the sensor 134 activates the sprayer 108. In various embodiments, the detection zone 404 is configured by the position of the sprayer 108 as well as the height of the basin 102. The depth of the detection zone 404 may also be configured to select a distance from the sensor 134 where tableware 304 or cutlery activate the sprayer 108. In various embodiments, the sensor 134 may be a capacitive sensor, an infrared sensor, an ultrasonic sensor, or any other configurable sensor. When the sprayer 108 is activated, water is expelled through the rinse aperture 138.

In some embodiments, the basin rim 116 includes an inwardly protruded tube (as shown in FIG. 3). The rinse conduit 132 and the ring conduit 204 may be disposed within the inwardly protruded tube. These embodiments have the benefit that the inwardly protruded tube prevents the respective apertures from being blocked (e.g., causing water to backsplash outside of the basin 102. The inwardly protruded tube also may also be installed retroactively such that the integrated rinse system 200 may be installed after the installation of the sink system 100. In other embodiments, the integrated rinse system 200 does not include the inwardly protruded tube (as shown in FIG. 4). In these embodiments, the rinse conduit 132 and the ring conduit 204 are integrated within the along the basin 102. These embodiments benefit from an aesthetically pleasing "sleek" look due to being flat to the walls of the basin 102. These embodiments also benefit from reduced assembly costs due to the rinse conduit 132 and the ring conduit 204 integrated into the basin 102.

Figure 5:
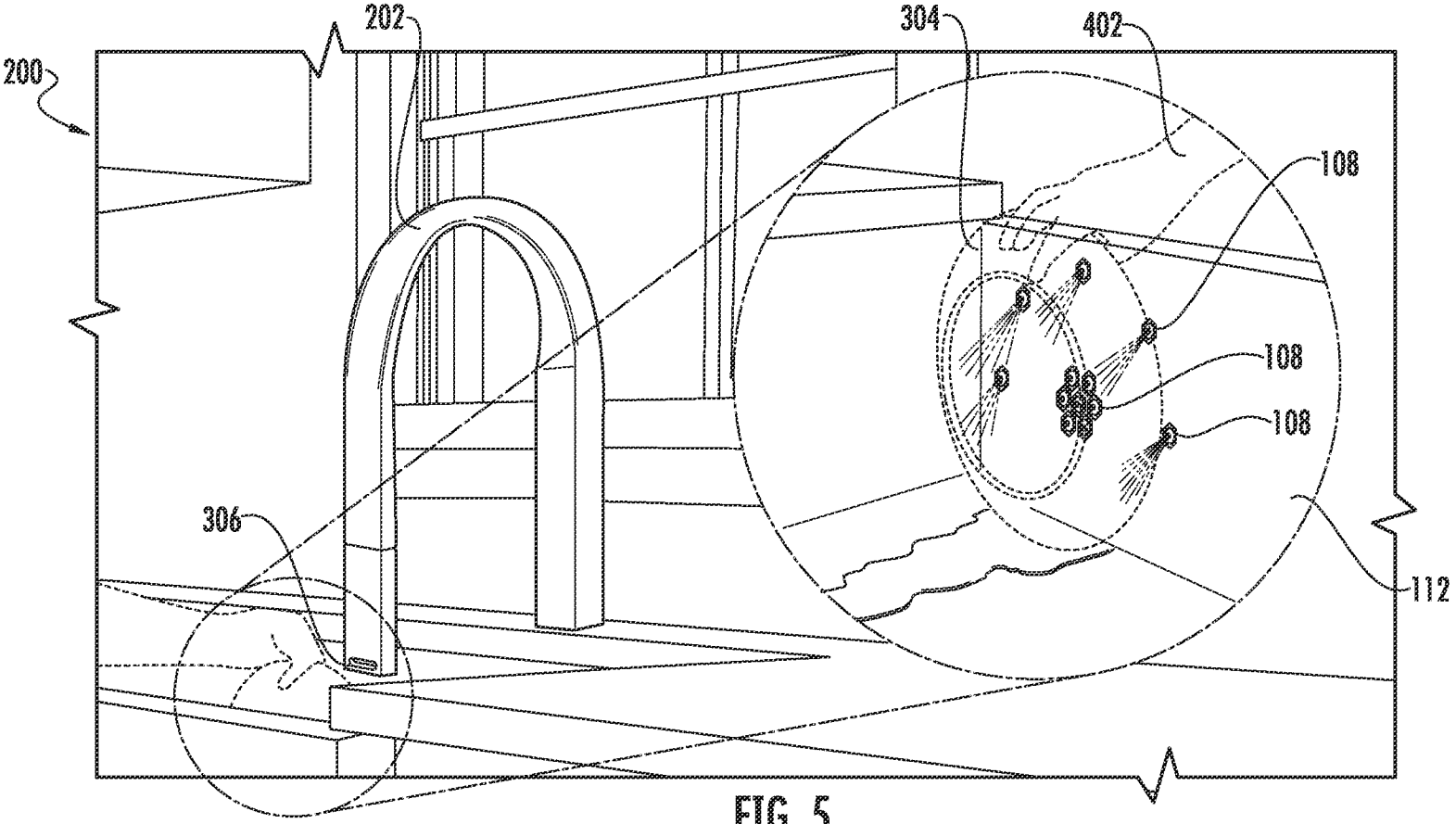
FIG. 5 is a front side perspective view of the sink system of FIG. 1 illustrating the sprayers and sensors located along the basin of the sink, according to some embodiments.

FIG. 5 illustrates an example embodiment of the integrated rinse system 200. In the example embodiment, more than one sprayer 108 is shown positioned along the front wall 112. The user 402 is holding tableware 304 within the vicinity of more than one active sprayer 108. This configuration facilitates more than one sprayer 108 to rinse along various points of the basin 102. In an example embodiment, each sprayer 108 has a dedicated sensor 134. In various embodiments, each of the sprayers 108 is activated when any one of the sprayers 108 is activated.

Figure 6:
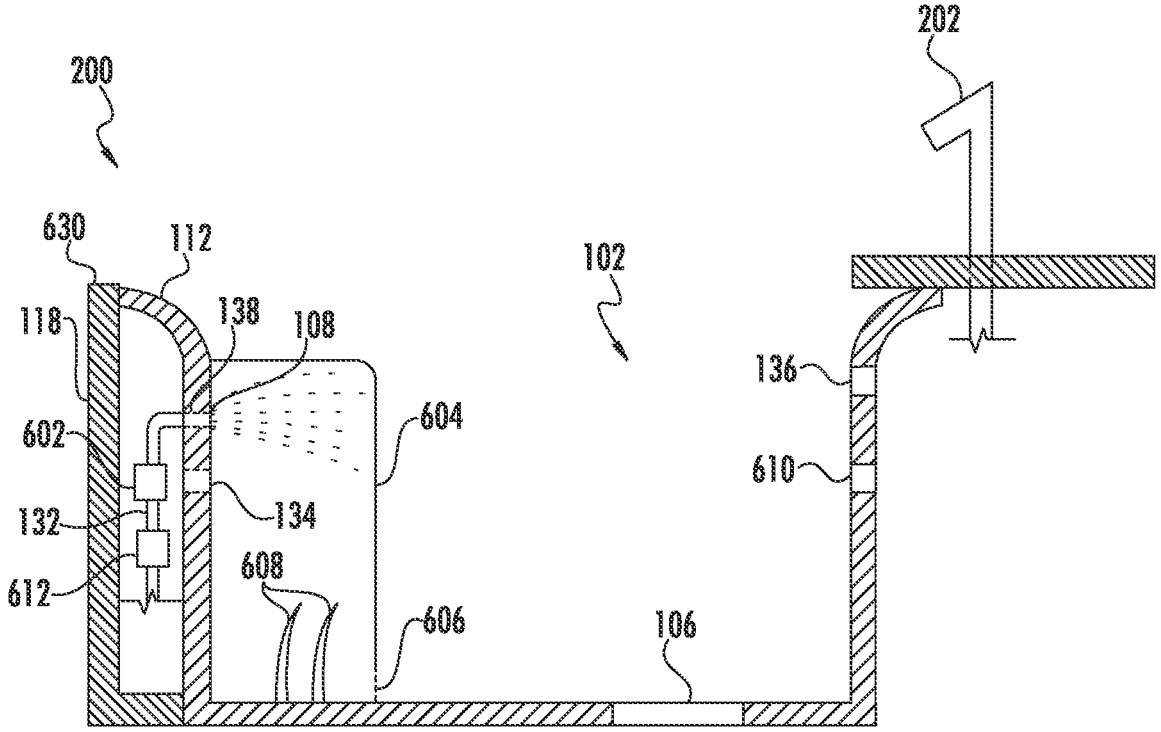
FIG. 6 is a cross-sectional side view of the sink system of FIG. 1 illustrating a removable cover located in the basin of the sink, according to some embodiments.

FIG. 6 shows a cross-section of the basin 102, according to an exemplary embodiment. In an example embodiment, the rinse conduit 132 is located between the front wall 112 and the apron 118. The rinse conduit 132 may be coupled to a first end of a quick connect fitting 602 (e.g., quick coupling, connect fitting, faucet connector, etc.). A second end of the quick connect fitting 602 is coupled to the sprayer 108. In an example embodiment, the integrated rinse system 200 includes a removable cover 604. The removable cover 604 facilitates the integrated rinse system 200 to incorporate a dishwashing mode with a removable dishwashing area.

The removable cover 604 may be positioned within the basin 102. In some exemplary embodiments, the removable cover 604 removably couples to a designated area of the basin 102 through a coupling mechanism, such as slotting, snap-fits, magnets, etc. In some other exemplary embodiments, the removable cover 604 is configured to couple to anywhere within the basin 102. In these embodiments, the removable cover 604 may be placed anywhere within the basin 102 or may be coupled through a coupling mechanism (e.g., magnets, etc.).

The removable cover 604 may include a cover drain 606 to drain water stored within the removable cover 604. The removable cover 604 may further include dividers 608 (e.g., fins, etc.) to organize tableware 304 within the removable cover 604. When the removable cover 604 is in place, the user 402 activates the dishwashing mode by pressing a dishwashing button 630 (e.g., switch, knob). The dishwashing button 630 may be located adjacent to the rinse button 140. In various embodiments, the dishwashing button 630 and the rinse button 140 may be controlled through an auxiliary device (e.g., smartphone application). In an example dishwashing mode, the sprayer 108 is activated for a predetermined amount of time to complete a rinse cycle. As discussed in greater detail above, the rinse conduit 132 may be configured to produce a hot mist and to selectively inject soap into the sprayer 108. In some embodiments, the rinse conduit 132 provides cold water to the sprayer and/or alternates between hot water, cold water, and a mist.

Water and soap from the sprayer 108 then exit the removable cover through the cover drain 606. The water enters the basin 102 and exits via the drain 106. In various embodiments, the dishwashing mode may only be activated when the integrated rinse system 200 senses the removable cover 604 is in position within the basin 102 via sensor 134 or another sensor.

In some embodiments, the integrated rinse system 200 includes an overflow hole 610 (e.g., safety drain aperture, etc.). The overflow hole 610 is disposed on a wall of the basin 102 (e.g., such as the front wall 112, rear wall 109, etc.) and may be fluidly coupled with the drain 106 of the basin 102 via an overflow conduit that extends between the overflow hole 610 and the drain 106. The overflow hole 610 diverts water within the basin 102 that has reached the height of the overflow hole 610 to the drain 106 of the basin 102.

In some embodiments, the integrated rinse system 200 includes a vacuum breaker 612 (e.g., check-valve, unidirectional valve, etc.). The vacuum breaker 612 is positioned upstream of the plurality of rinse apertures 138 along the ring conduit 204 and/or the rinse conduit 132. The vacuum breaker 612 is configured to prevent the reverse flow of water into the plurality of rinse apertures 138 from within the basin 102. Before traveling to the rinse conduit 132 and the ring conduit 204, the water passes through the vacuum breaker 612. In the absence of the vacuum breaker 612, used water (e.g., water mixed with soap or debris from the tableware 304) could enter the openings in the rinse conduit 132 and/or the ring conduit 204 because such openings may be located below the overflow hole 610 and may be inadvertently returned to the water supply 206. The vacuum breaker 612 prevents this by allowing water to flow in a single direction and prevents reverse flow of used water the basin 102 into the rinse conduit 132 and/or the ring conduit 204. This is advantageous as it prevents back flushing of used water into the water supply 206.

Figure 7:
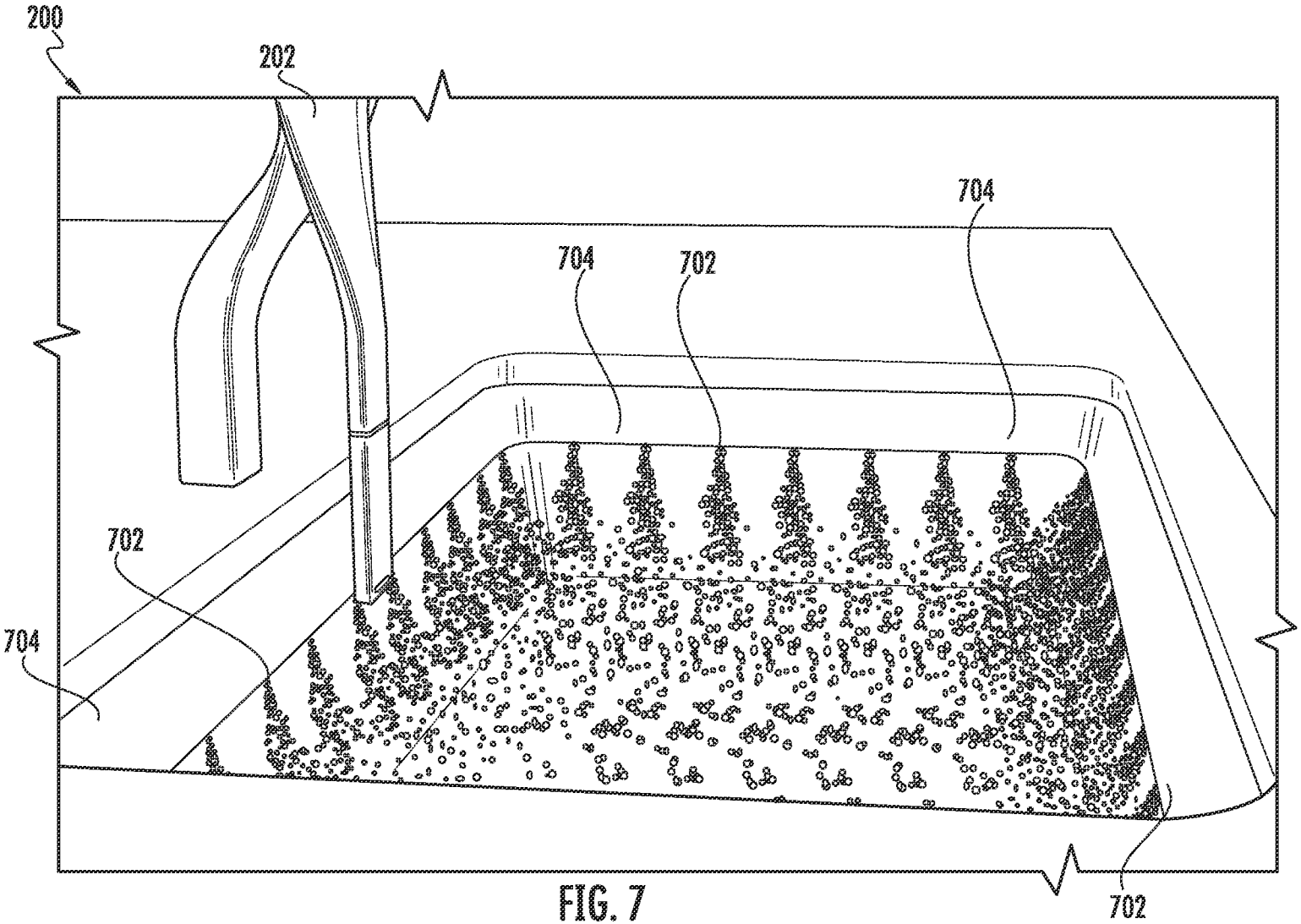
FIG. 7 is a side perspective view of the sink system of FIG. 1 illustrating sprayers located along the rim of the sink, according to some embodiments.
Figure 8:
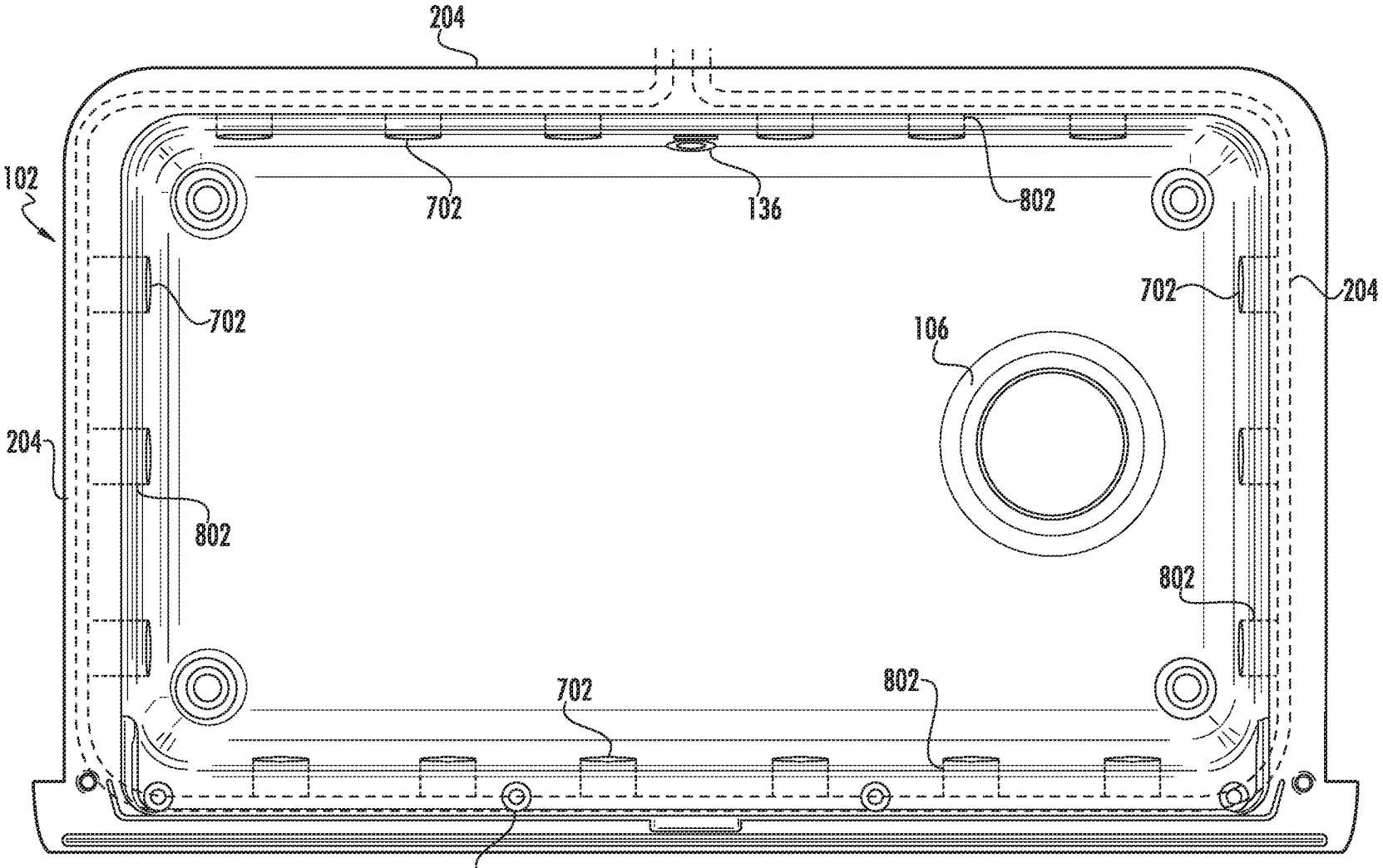
FIG. 8 is a top view of the sink system of FIG. 7 illustrating a water conduit positioned along the rim of the sink, according to some embodiments.

As shown in FIGS. 7 and 8, the integrated rinse system 200 may include a ring spray 702 that is disposed along a perimeter of the basin 102. In an example embodiment, the ring spray 702 is activated when the faucet end 208 is positioned in the faucet enclosure 136. In various embodiments, the ring spray 702 may be activated by a button (e.g., switch, knob, smartphone application). The ring spray 702 is fluidly communicable with the ring conduit 204. At various points along the length of the ring conduit 204, a plurality of ring apertures 802 may branch off into the interior of the basin 102. When the ring spray 702 is activated, water may exit the ring spray 702 at various locations along the perimeter of the basin 102. In an example embodiment, the ring spray 702 is positioned at a downward angle, towards the bottom wall 104 of the basin 102, so as to rinse the sides of the basin 102 and provide a sink cleaning function. Positioning at a downward angle also helps to prevent water from splashing out of the basin 102. In various embodiments, the ring spray 702 is oriented to spray at an inclined angle toward an interior of the basin 102.

Along the length of the ring spray 702 is a ring perimeter 704. The ring perimeter 704 extends the length of the basin rim 116. The ring perimeter 704 acts as a cover for the ring spray 702. In various embodiments, the ring spray 702 is configured to spray only along specific sides of the sink system 100. For example, if the dishwashing mode is activated, and accordingly the ring spray 702 is activated, the ring spray 702 may be configured only to expel water on the side opposite the removable cover 604. In various configurations, the ring spray 702 is configurable to only activate specific points. In various configurations, the ring spray 702 is programmable to activate specific points based on a time sequence.

Figure 10:
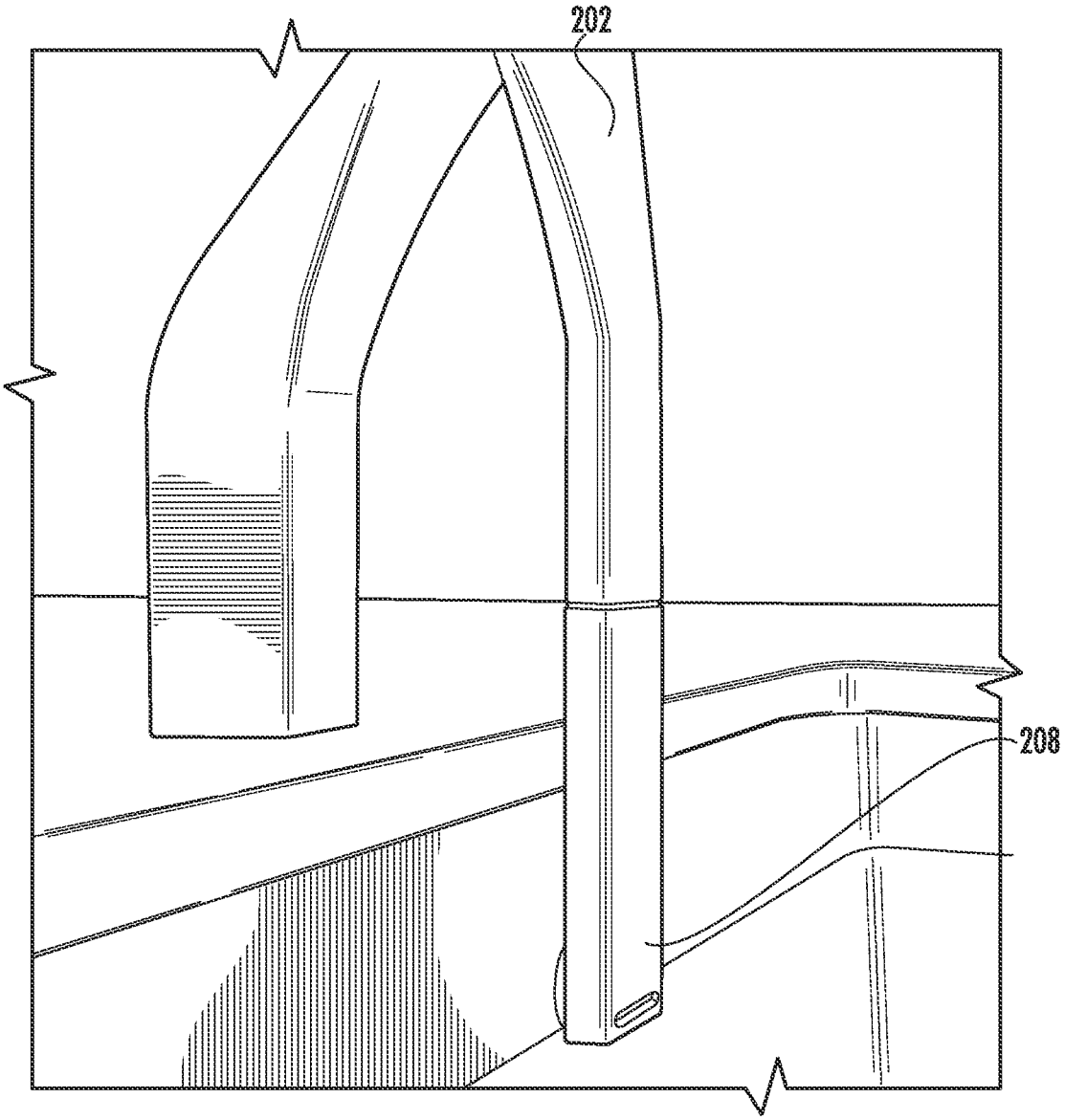
FIG. 10 is a side perspective view of the sink system of FIG. 1 illustrating the faucet positioned in the faucet enclosure for the sink, according to some embodiments.

FIG. 9 illustrates an embodiment where the faucet end 208 is not positioned in the faucet enclosure 136. FIG. 10 illustrates an embodiment where the faucet end 208 is positioned in the faucet enclosure 136. When the faucet end 208 is positioned in a faucet enclosure, the faucet 202 is fluidly communicable with the ring conduit 204. When the faucet end 208 is positioned in the faucet enclosure 136, it may couple the faucet end 208 to the faucet enclosure 136. The faucet enclosure 136 may couple to the faucet end 208 by opposing magnetic forces, by surface friction, or various other coupling mechanisms. The faucet enclosure 136 may include a gasket to prevent fluid from escaping out of the faucet enclosure 136.

Figure 11:
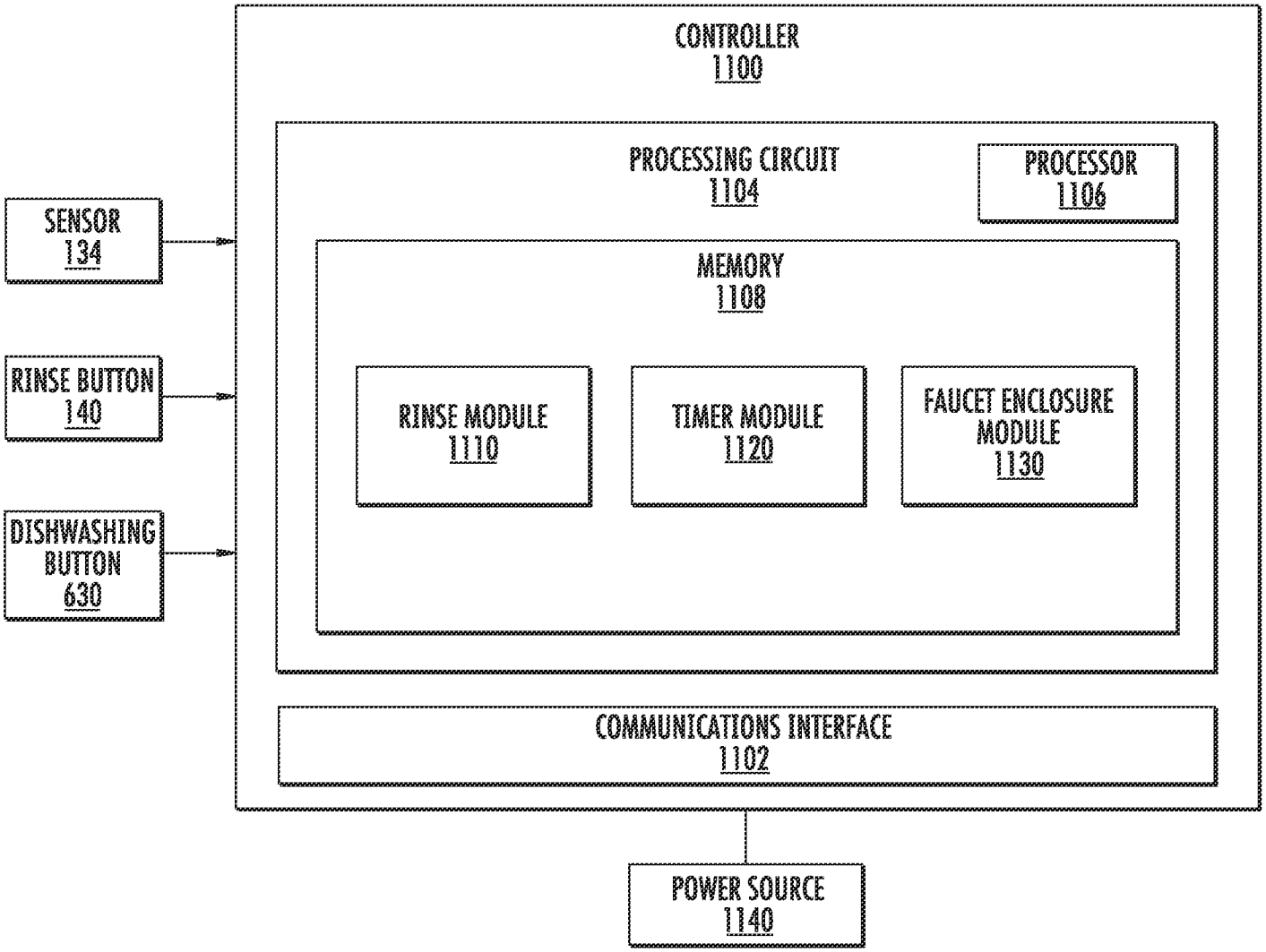
FIG. 11 is a block diagram of a controller associated with the sink system of FIG. 1, according to some embodiments.

As shown in FIG. 11, the integrated rinse system includes a controller 1100. The controller 1100 is in electronic communication with electronic valves which control the operation of faucet end 202, the rinse conduit 132 and the ring conduit 204 (e.g., via a wired connection, via a wireless connection, etc.). The electronic valves are configured to allow, stop, or limit the water dispensed respectively by the faucet end 202, the rinse conduit 132 and the ring conduit 204. The controller 1100 is shown to include a communications interface 1102 and a processing circuit 1104. The communications interface 1102 may include wired or wireless interfaces (e.g., jacks, antennas, transmitters, receivers, transceivers, wire terminals, etc.) for conducting data communications with various systems, devices, or networks. For example, the communications interface 1102 may include an Ethernet card and port for sending and receiving data via an Ethernet-based communications network and/or a WiFi transceiver for communicating via a wireless communications network. The communications interface 1102 may be configured to communicate via local area networks or wide area networks (e.g., the Internet, a building WAN, etc.) and may use a variety of communications protocols (e.g., BACnet, IP, LON, etc.).

The communications interface 1102 may be a network interface configured to facilitate electronic data communications between the controller 1100 and various external systems or devices (e.g., the sensor 134, the rinse button 140, the dishwashing button 630, etc.). For example, the controller 1100 may receive a signal from a button (e.g., such as the rinse button 140, the dishwashing button 630, etc.) indicating the preferred spraying mode by the user. The communications interface 1102 may then communicate with electronic valves controlling operating of the faucet 202, the rinse conduit 132, and the ring conduit 204.

Still referring to FIG. 11, the processing circuit 1104 is shown to include a processor 1106 and memory 1108. The processor 1106 may be a general purpose or specific purpose processor, an application specific integrated circuit (ASIC), one or more field programmable gate arrays (FPGAs), a group of processing components, or other suitable processing components. The processor 1106 may be configured to execute computer code or instructions stored in the memory 1108 or received from other computer readable media (e.g., CDROM, network storage, a remote server, etc.).

The memory 1108 may include one or more devices (e.g., memory units, memory devices, storage devices, etc.) for storing data and/or computer code for completing and/or facilitating the various processes described in the present disclosure. The memory 1108 may include random access memory (RAM), read-only memory (ROM), hard drive storage, temporary storage, non-volatile memory, flash memory, optical memory, or any other suitable memory for storing software objects and/or computer instructions. The memory 1108 may include database components, object code components, script components, or any other type of information structure for supporting the various activities and information structures described in the present disclosure. The memory 1108 may be communicably connected to the processor 1106 via the processing circuit 1106 and may include computer code for executing (e.g., by the processor 1106) one or more processes described herein.

The memory 1108 may include various modules which are capable of being implemented by the processor 1106 to cause various processes to take place.

In some embodiments, the memory 1108 includes a rinse module 1110. The rinse module 1110 is configured to control operation of the sprayer 108. For example, the rinse module 1110 may be configured to activate the sprayer 108 for different durations based on how much pressure is used to press the rinse button 140. In various embodiments, the rinse module 1110 may be configured to control operation of the sprayer 108 to convey information such as time, temperature of water flowing through the faucet 202, ambient temperature (e.g., of the air surrounding the basin 102), or other similar information. In some of these embodiments, the rinse module 1110 may be in electronic communication with other controllers or sensors (e.g., a temperature sensor) and utilize information from these other controllers or sensors to control operation of the sprayer 108. As discussed in greater detail above, the operation of the various spraying elements (e.g., such as the sprayer 108, etc.) are controller by electronic valves positioned along the respective spraying conduits. The electronic valves are configured to allow, stop, or limit the water dispensed by the various spraying elements. Further, each spraying element may incorporate their own electronic mixing valve configured to control the mixing of hot water and cold water. This is advantageous as it allows the various spraying elements to dispense water at different temperatures for a spraying mode. In some embodiments, the various spraying elements share an electronic mixing valve.

In some embodiments, the memory 1108 includes a timer module 1120. The timer module 1120 is configured to control operation of the rinsing mode and the dishwashing mode (e.g., independent of the rinse module 1110, in conjunction with the rinse module 1110). The time counter may be reset by the timer module 1120 in response to an event, such as the dishwashing button 630 being pressed. The timer module 1120 controls operation of the integrated rinse system 200 by providing signals to the electronic valves for each of the faucet 202, the ring conduit 204, and the rinse conduit 132. The rinsing mode and the dishwashing mode may have pre-programmed time counters (e.g., the amount of time water, soap, and/or a water-soap mixture are dispensed during the stages of rinsing and dishwashing, respectively) and/or programmed times by the user. In response to the user selecting the rinsing mode and/or the dishwashing mode, the timer module controls operation of the respective sprayers during the stages of the rinsing or dishwashing. When the time counter reaches the programmed time, the timer module 1120 stops providing signals to the electronic valves. The user may interrupt or pause the timer module 1120 by overriding the rinsing mode and the dishwashing mode by pressing a button (e.g., such as the rinse button 140) or through the smartphone application.

In some embodiments, the memory 1108 includes a faucet enclosure module 1130. The faucet enclosure module 1130 is configured to control operation of the water supply of the faucet 202. For example, the faucet enclosure module 1130 may be configured to operate a fluid control valve to start, stop, or variably adjust the supply of water from the faucet 202 to the ring conduit 204. In various embodiments, the faucet enclosure module 1130 may be configured to activate the top side outlet 302. The faucet enclosure module 1130 may be activated manually by the user 402 or automatically when the faucet end 208 is positioned in the faucet enclosure 136. As discussed above, the faucet enclosure module 1130 may determine the presence of the faucet in the faucet enclosure 136 through a sensor (e.g., magnetic sensors, hall effect sensors, proximity sensors, infrared sensor, etc.).

In some embodiments, the faucet 202 is configured to only dispense water from the bottom side faucet outlet 306 during normal operation. In response to the faucet 202 being connected to the faucet enclosure 136, the faucet 202 may be configured to dispense water from the top side faucet outlet 302 and the bottom side faucet outlet 306 concurrently. The top side faucet outlet 302 dispenses water (as shown in FIG. 3) from the top surface of the faucet 202, while the bottom side faucet outlet 306 provides water to the ring conduit 204 and/or the rinse conduit 132. This configuration allows for the sink system 100 to dispense water from the top side faucet outlet 302 and the ring conduit 204 and/or the rinse conduit 132. For example, the top side faucet outlet 302 may dispense water concurrently with the rinse conduit 132 as shown in FIG. 3.

The controller 1100 is in electronic communication with a power source 1140 (e.g., power supply). In some embodiments, the power source 1140 is a battery (e.g., a rechargeable battery). In some embodiments, the power source 1140 is an electrical grid (e.g., home electrical grid, kitchen electrical grid, etc.). In some of these embodiments, the controller 1100 may be connected to the power source 1140 via a cord with a plug that can be connected to a wall socket in a home or building.

The controller 1100 is configured to provide a signal to the processing circuit 1104 in response to a trigger from the sensor 134 (e.g., change in light proximate the sink system 100, detection of motion past the apron 118, etc.). The controller 1100 may be configured to control operation of the sprayer 108 in response to receiving the signal from the sensor 134. For example, as shown in FIG. 6, the sensor 134 may be incorporated into the front wall 112 and configured to detect a change of light in the basin 102. In this example, the controller 620 may be configured to activate the sprayer 108 in response to detecting the change in light (e.g., the light proximate the basin 102 drops below a threshold) or the detected motion.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

The hardware and data processing components used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

It is important to note that the construction and arrangement of the system as shown in the various exemplary embodiments is illustrative only. Additionally, any element disclosed in one embodiment may be incorporated or utilized with any other embodiment disclosed herein. For example, the removable cover 604 of the exemplary embodiment of FIG. 6 may be incorporated in the exemplary embodiment of FIGS. 2 and 7. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A sink system comprising:

a basin comprising a first wall configured to contain water within the basin;

a faucet coupled to the basin; and a rinsing system integrated with the basin and comprising:

one or more water outlets located along the first wall of the basin, the one or more water outlets being configured to dispense water into the basin; and a fluid conduit fluidly coupled to the one or more water outlets and configured to deliver water to the one or more water outlets.

2. The sink system of claim 1, wherein:

the basin further comprises a second wall adjacent to or opposite the first wall;

the faucet is coupled to the basin above the second wall;

the one or more water outlets are configured to dispense the water into the basin in a direction substantially perpendicular to the second wall when the first and second walls are adjacent; and the one or more water outlets are configured to dispense the water into the basin in a direction substantially from the first wall toward the second wall when the first and second walls are opposite.

3. The sink system of claim 1, wherein:

the basin comprises one or more additional walls coupled to the first wall, the first wall and the one or more additional walls-forming a perimeter of the basin; and the one or more water outlets comprise a plurality of water outlets distributed across the first wall and the one or more additional walls along the perimeter of the basin.

4. The sink system of claim 1, wherein the faucet comprises a first faucet outlet located along a first surface of the faucet and configured to dispense water from the faucet, and wherein:

the fluid conduit comprises a faucet connector configured to connect to the first faucet outlet; and the fluid conduit is configured to receive the water dispensed from the first faucet outlet via the faucet connector and deliver the water from the faucet to the one or more water outlets.

5. The sink system of claim 4, the faucet further comprising a second faucet outlet located along a second surface of the faucet opposite the first surface and configured to dispense water from the faucet into the basin concurrently with the faucet providing water to the fluid conduit via the first faucet outlet.

6. The sink system of claim 1, wherein the fluid conduit is:

fluidly coupled to a water source via a water line that extends through a wall of the basin; and configured to receive the water from the water source via the water line and deliver the water from the water source to the one or more water outlets.

7. The sink system of claim 1, wherein:

the basin comprises an overflow hole located along a wall of the basin and configured to direct at least some of the water within the basin to a drain when a water level of the water within the basin reaches the overflow hole; and a first distance between the one or more water outlets and a bottom surface of the basin is less than a second distance between the overflow hole and the bottom surface of the basin such that the water level is above the one or more water outlets when the water level reaches the overflow hole.

8. The sink system of claim 1, further comprising a vacuum breaker configured to prevent the water within the basin from flowing into the one or more water outlets.

9. A sink system comprising:

a faucet comprising:

a first faucet outlet located along a first surface of the faucet and configured to dispense water from the faucet in a first direction; and a second faucet outlet located along a second surface of the faucet opposite the first surface and configured to dispense water from the faucet in a second direction opposite the first direction; and a basin comprising:

one or more water outlets located along a wall of the basin; and a fluid conduit configured to connect to the first faucet outlet, receive water dispensed from the faucet via the first faucet outlet, and deliver the water dispensed from the faucet to the one or more water outlets located along the wall of the basin.

10. The sink system of claim 9, further comprising one or more electronic valves operable to control a flow of water from the first faucet outlet and the second faucet outlet; and a controller configured to operate the one or more electronic valves to control the flow of water from the first faucet outlet and the second faucet outlet.

11. The sink system of claim 10, further comprising a sensor configured to detect whether the first faucet outlet is connected to the fluid conduit;

wherein the controller is configured to cause the faucet to dispense the water from both the first faucet outlet and the second faucet outlet concurrently responsive to detecting that the first faucet outlet is connected to the fluid conduit.

12. The sink system of claim 9, wherein:

the fluid conduit comprises a faucet connector located along a first wall of the basin and configured to connect the first faucet outlet to the fluid conduit;

the fluid conduit extends around the basin from the first wall of the basin to a second wall of the basin opposite the first wall of the basin; and the one or more water outlets are located along the second wall of the basin.

13. The sink system of claim 9, wherein when the first faucet outlet is connected to the fluid conduit:

the water dispensed from the first faucet outlet in the first direction flows into the fluid conduit via a faucet connector and then from the fluid conduit into the basin via the one or more water outlets located along the wall of the basin; and the water dispensed from the second faucet outlet in the second direction flows directly into the basin from the second faucet outlet.

14. The sink system of claim 9, wherein: the wall of the basin is a first wall;

the basin comprises one or more additional walls coupled to the first wall, the first wall and the one or more additional walls forming a perimeter of the basin with the first wall; and the one or more water outlets comprise a plurality of water outlets distributed across the first wall and the one or more additional walls along the perimeter of the basin.

15. A sink system comprising:

a basin comprising a plurality of water outlets located along one or more walls of the basin and configured to spray water into the basin;

a removable cover configured to attach to the basin and enclose at least a portion of the basin comprising the plurality of water outlets; and a controller configured to operate in a dishwashing mode in which the controller causes the plurality of water outlets to spray the water into the basin according to a predetermined dishwashing cycle.

16. The sink system of claim 15, further comprising a cleaning agent reservoir configured to store a supply of cleaning agent;

wherein the dishwashing cycle comprises:

a washing sub-cycle during which the cleaning agent mixes with the water upstream of the plurality of water outlets and a mixture of the cleaning agent and the water sprays into the basin via the plurality of water outlets; and a rinsing sub-cycle during which the cleaning agent is prevented from mixing with the water upstream of the plurality of water outlets and rinse water sprays into the basin via the plurality of water outlets.

17. The sink system of claim 15, further comprising a faucet comprising:

a first faucet outlet located along a first surface of the faucet and configured to dispense water from the faucet in a first direction; and a second faucet outlet located along a second surface of the faucet opposite the first surface and configured to dispense water from the faucet in a second direction opposite the first direction.

18. The sink system of claim 17, further comprising:

one or more electronic valves operable to control a flow of water from the first faucet outlet and the second faucet outlet; and the controller further configured to operate the one or more electronic valves to control the flow of water from the first faucet outlet and the second faucet outlet.

19. The sink system of claim 18, further comprising a sensor configured to detect whether the first faucet outlet is connected to a faucet enclosure disposed in the basin;

wherein the controller is configured to cause the faucet to dispense the water from the second faucet outlet responsive to detecting that the first faucet outlet is connected to the faucet enclosure.

20. The sink system of claim 18, further comprising a sensor configured to detect whether the first faucet outlet is connected to a fluid conduit fluidly coupled to the plurality of water outlets;

wherein the controller is configured to cause the faucet to dispense the water from both the first faucet outlet and the second faucet outlet responsive to detecting that the first faucet outlet is connected to the fluid conduit.

* * * * *